United States Patent [19]
Wooten
[11] 4,236,600
[45] Dec. 2, 1980

[54] VERTICAL HORIZONTAL RESCUE SYSTEM

[76] Inventor: William Wooten, 238 Moye Ave., Biloxi, Miss. 39532

[21] Appl. No.: 922,650

[22] Filed: Jul. 7, 1978

[51] Int. Cl.³ ..... A62B 1/06
[52] U.S. Cl. ..... 182/43; 182/3
[58] Field of Search ..... 182/42, 43, 44, 3, 14, 182/13, 12

[56] References Cited

U.S. PATENT DOCUMENTS

| | | | |
|---|---|---|---|
| 329,190 | 10/1885 | McKinzie | 182/42 |
| 640,099 | 12/1899 | Cotter | 182/43 |
| 641,121 | 1/1900 | Knight | 182/42 |
| 1,106,608 | 8/1914 | Wukstich | 182/43 |
| 1,282,201 | 10/1918 | Drake | 182/43 |

*Primary Examiner*—Reinaldo P. Machado
*Attorney, Agent, or Firm*—Calvin J. Laiche

[57] ABSTRACT

The present invention provides an emergency fire escape system for decending from elevated buildings during a fire. The present system in its simplies embodiment comprises of a pair of vertically oriented spaced apart continuous cables positioned along side an elevated structure having natural openings positioned between the cables, that is, windows, fire escapes, exits, or the like. The top portion of each cable passes through an adjustable pulley member rigidly affixed to the respective top portion of the building at which an given cable is located. The bottom portion of each cable is operably connected to separate gear motors having a pulley upon which each respective cable passes. The individual gear motors are synchronized such that the respective cables travel in unison over the gear motor pulleys. A separate cable is strung across and is rigidly affixed at the same elevation to the spaced a part continuous cable members which extends in a vertical position, the separate cable extending in a horizontal position. Upon operation of the gear motors, the horizontal cables can be lowered past the building exits whereby an occupant can attach a harness device that he is wearing to the horizontal cable member to thus be lowered to the ground during an escape operation.

Separate portable power connecting members and control devices are also included which are operably attached to the building structure.

3 Claims, 3 Drawing Figures

VERTICAL HORIZONTAL RESCUE SYSTEM

DESCRIPTION OF THE DRAWINGS

For a better understanding of the nature and objects of the invention, reference should be had to the following drawings taken in conjunction with the detailed description thereof. In the drawings, synonoymous reference numerals are employed throughout in the various views to refer to identical components.

FIG. 3 in the drawings illustrates a front of belt or harness strap which can be employed in conjunction with the present escape system.

BACKGROUND OF THE INVENTION

Figure 1:
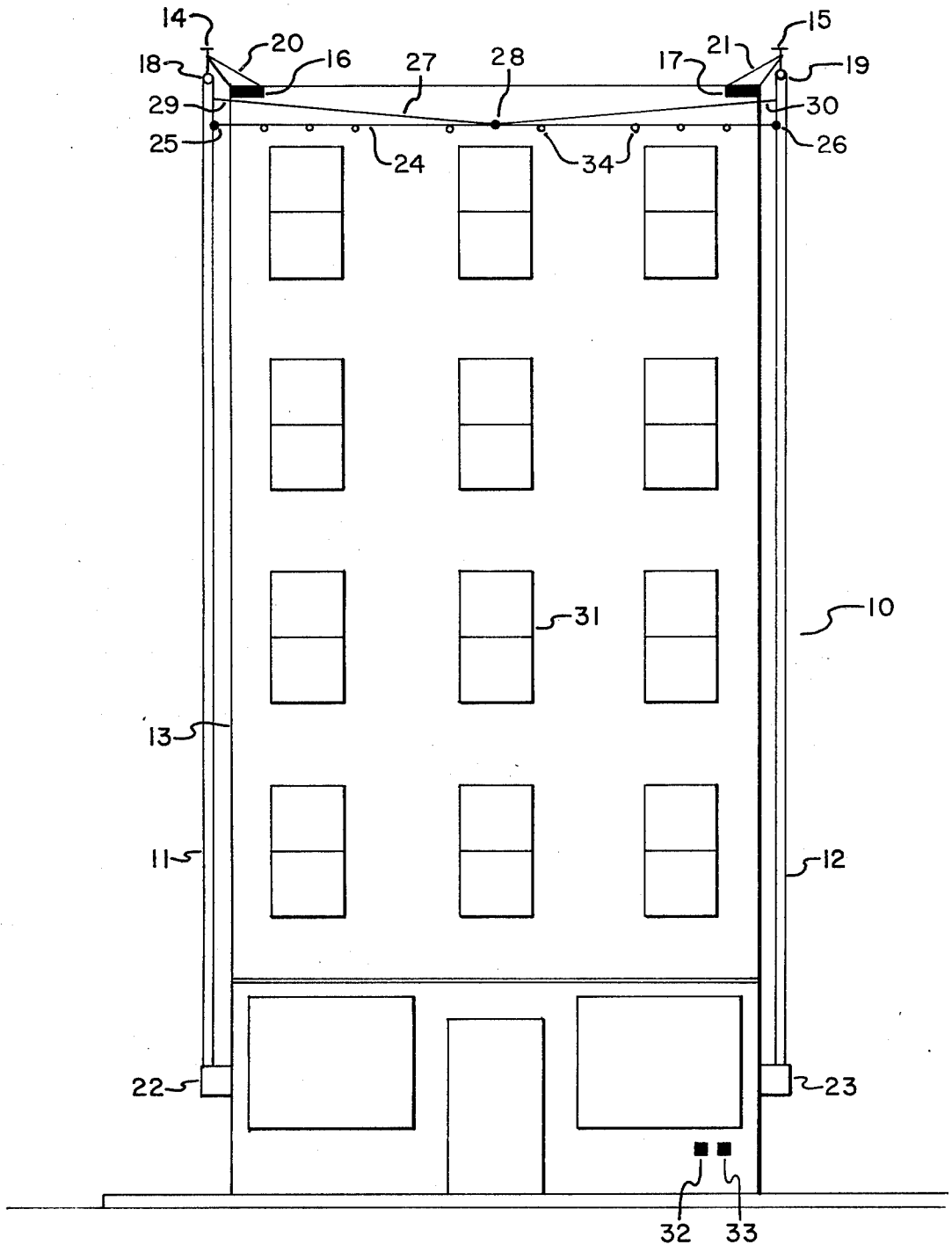
FIG. 1 in the drawings represents a front elevational view of a building upon which the present emergency escape system is shown installed.
Figure 1:
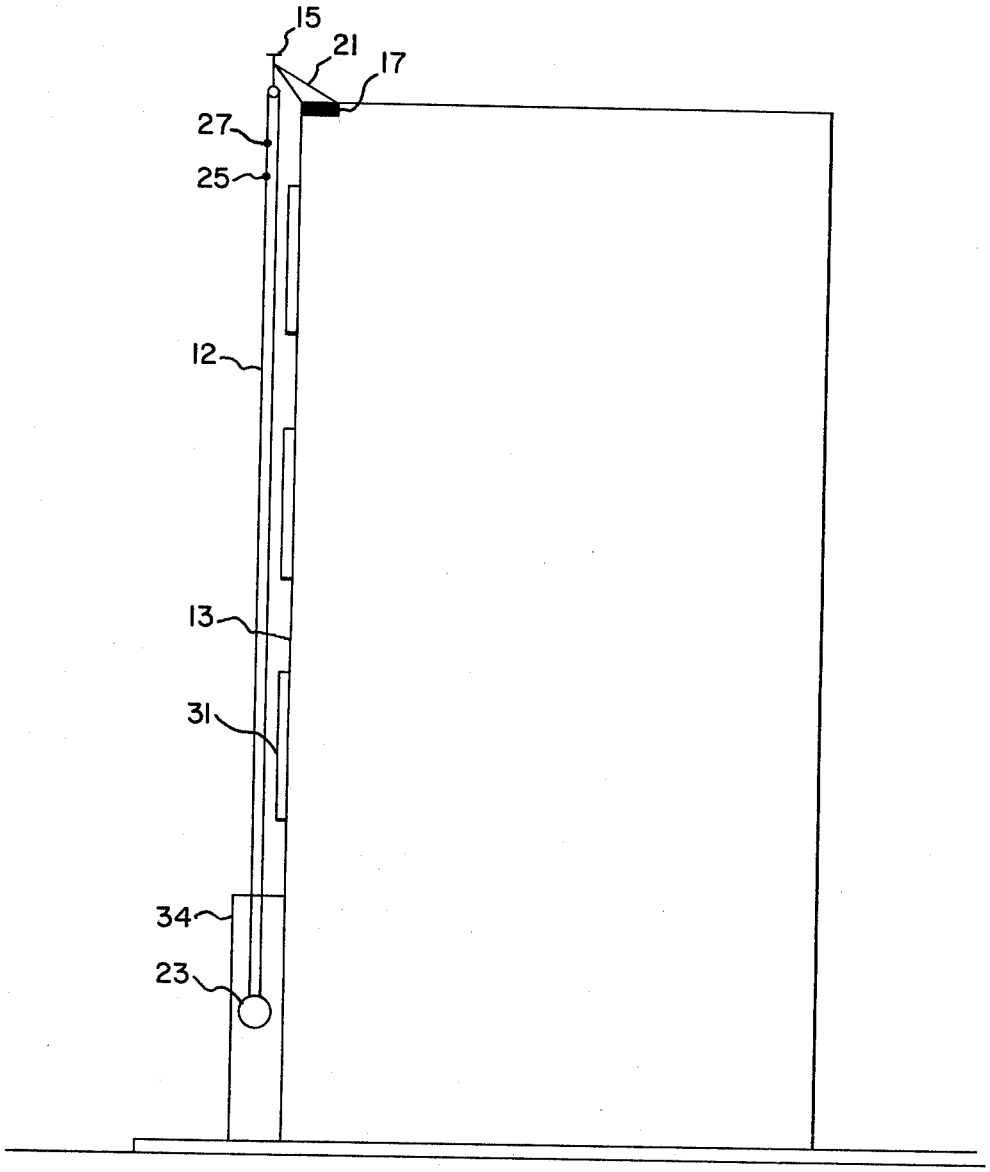

This invention is concerned with emergency descent devices, more particular to an emergency descent system comprising a series of cables to which a party can attach himself via a harness to be thus lowered from a structure on which the present system is installed.

Emergency escape devices utilizing various types of mechanical devices employing a cable whether it be under the control of the escaping person or separately controled is old and well known in the arts. However, these prior art devices are generally characterized as being somewhat complex in their mechanical design, as well as difficult to use by the operator.

It is an object of the present invention to provide an emergency escape device or system for use in decending from dangerous locations such as a burning high rise apartment or office building. Among the many advantages and features of the present invention is the fact that it is simply constructed and very easy to maintain and operate. Moreover, it is relatively inexpensive and a building could be equipped with a multitude of the present devices at a relatively low initial investment. The above together with other features and advantages of the instant invention will be apparent to one skilled in the art in light of the details of construction and operation of the present emergency descent system as shown in the drawings and described in the ensuing detailed disclosure of its preferred embodiment which is particularly pointed out in the appended claims.

DESCRIPTION OF THE PREFERRED EMBODIMENT(S)

Referring to FIG. 1 in the drawings, the present emergency descent system 10 further comprises the spaced apart horizontally positioned set of cable means 11 and 12. Each of the cables 11 and 12 extend essentially from the bottom of the building 13 upwards to essentially the top thereof where they are rotatably mounted on some convenient portion of the structure 13, generally at opposite corners of one side of the building as shown in FIG. 1 of the drawings, for example by virtue of the pulley assemblies 14 and 15. Each of the members 14 and 15 comprise a base member 16 and 17 respectively to which the adjustable pulley assemblies 18 and 19 are rigidly affixed by virtue of the support arms 20 and 21. The pulley assemblies 18 and 19 are vertically adjustable to provide a method of taking slack out of the cables 11 and 12. The respective cables 11 and 12 are passed over and through the pulley members 18 and 19 and rotatably positioned whereby such that the individual cables 11 and 12 can be pulled up and down accordingly.

The respective cables 11 and 12 are in turn rotatably mounted at their lower elevation by virtue of the respective gear motor means 22 and 23 which can comprise any well known conventional design of electrically actuated means having a pulley (not shown) upon which the respective cables 11 and 12 are passed whereby the cables can be conveyed. Naturally, such gear means can be hand operated either alone or alternatively should the electrical system fail. In any event, the electrical system provided for operation of the winches should preferably be made a separate circuit located exteriorly on the building and enclosed in fire proof conduit. Generally, the cables 11 and 12 would be continuous and their lower end wrapped around a drum, preferably 5–6 wraps around the drum, which is driven and forms a part of the gear motor 22 and 23. This particular design of cable conveyance means is old and well known in the arts. The cable drivers 22 and 23 are sychronized such that they will operate in unison for the reasons explained hereinafter.

The spaced apart cables 11 and 12 are operably attached to each other by virtue of the horizontal positioned connecting cable member 24 which is rigidly affixed thereto at its ends 25 and 26. The support cable member 27 is provided for strengthing the cable member, 24 as well as holding up some of the weight to which the cable member 24 is subjected as explained below. The support cable 27 is attached at its middle 28 to cable member 24 and its upper ends attached to respective cables 11 and 12 at the positions 29 and 30. By such an arrangement, the cable member 24 is prevented from bending extensively in the middle.

As shown in FIG. 1 of the drawings, the cable assemblies 11 and 12 are spaced apart across some suitable series of exits or openings provided in the building 13, for example, across the various windows 31 as shown. Thus, upon an emergency, the windows 31 can be opened and/or broken through and upon an operator below passing the cable member 24 into position outside a respective window where an occupant is to be rescued from, the occupant can thereupon attach himself to the cable member 24'. Generally, the occupant will be provided with a suitable harness, such as a common type of parachute, linesman harness, or the like which has a snap buckle or clasp thereon whereby the occupant will then suspend himself upon the cable 24 upon jumping out of the window, see FIG. 3 of the drawings. Thereafter, the occupant can be lowered to the ground by virtue of actuation of the gear motor assemblies 22 and 23.

The cross or suspension cable means 24 is preferably provided with the stops 34 which serve to prevent persons suspended on the cable member 24 by a harness snap from sliding towards each other due to their weight causing the cable 24 to sag. Otherwise, the parties suspended on the cable 24 at anyone time would slide over toward each other and thereby may present a safety problem.

Referring to FIG. 3 of the drawings, the present invention would include a series of the harness belt means 40 with in further comprises the central belt portion 41 which is adapted to fit around the waist of the human in the conventional fashion as would a common belt. To ensure that the member 40 will support the weight, as well as for safety reasons due to high stress factors, such as that which would be encountered upon a person jumping and placing the belt members 41 under a high stress, the member 41 is preferably provided with and/or attached to the cable member 42. The cable member 42 can comprise either ¼ inch cable which will normally hold up to 1,240 lbs. or ½ inch cable which would normally design to hold at least 2,500 lbs. The harness snap 43 is positioned at one end of the harness belt 40, being operably attached to the ring member 44 which in turn is attached to the belt body portion 41 and the cable means 42. Such connections would be made to withstand considerable forces for the reasons brought out above. The opposite end of the belt body 41 is also provided with the ring member 45 which in turn is rigidly affixed to the belt body portion 41 and the cable means 42. The ring member 45 is made of a sufficient inside diameter such that the snap means 43 and the attachment ring 44 would pass there through whereby the belt assembly 40 would be self-adjusted to accommodate any size of person. Of course, the central belt portion 41 would be at least narrowed at the location 46 so as to allow it to pass through the ring member 45. In use, the operator would pass the harness snap 43 and 44 through the ring member 45 after placing the assembly 40 around their waist and thereupon would then snap the harness snap 43 upon the horizontal suspension cable member 24 as shown in FIG. 1 of the drawings. In such fashion, after the user leaves the building exit, there would be suspended upon the cable 24 which can thereupon be lowered to the ground.

Figure 2:
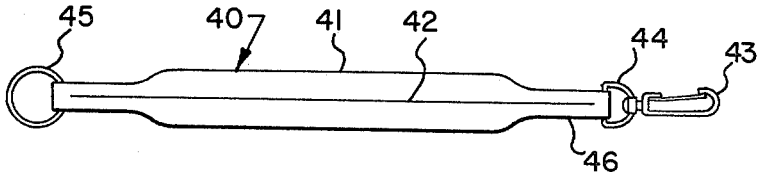
FIG. 2 in the drawings represents a side elevation view of the view shown in FIG. 1.

Controls for the gear motor assemblies 22 and 23 are preferably located both inside (not shown) and outside so that if the particular emergency situation would require that the occupants of the building 13 vacate the first floor, then the exterior emergency control as shown in FIG. 1 would allow fireman to so actuate the present system. As shown in FIG. 1, controls for the present system would preferably comprise the control box member 32 which is the power source for the gear motor cable driving assemblies 22 and 23. Such controls could comprise a conventional push button type of device with some suitable locking means thereon to prevent anyone from playing with the controls on the street. Additionally, if in the event the electrical power system for the building 13 should fail or be cut off for some reason, then the system would likewise preferably be provided with the auxiliary power source inlet 33 whereby a fireman could hook-up a portable power unit, such as an emergency generator to thereby furnish electricity to the system. Referring to FIG. 2 in the drawings, which figure represents a right hand view of the elevational view shown in FIG. 1, the gear motor assemblies, such as 23 is shown, would be mounted on the side of some suitable extension of the building as shown, for example, the extended wall portion 34.

It will be apparent to one skilled in the art that there are many changes and modifications that can be made in the above device as well as in its mode of operation without departing from the true scope and spirit of the present invention. For example, the particular design of cross cable member 25 can be varied, in fact, a rigid support member can be extended between the cable assemblies 11 and 12. Additionally, more support cables other then the member 27 can be employed. Additionally, the pulley block assemblies 14 and 15 can vary considerably in design and actually made to appear to be part of the building cornices for esthetic purposes. Likewise, the cable driving members 22 and 23 can vary considerably in that they could comprise of separate drums upon which the cable ends are wound rather then a single drum and the members 11 and 12 being a continuous length of cable. Additionally, a pulley assembly can be located at the bottom such that the members 22 and 23 be actually built inside of the walls whereby they would function in the same manner but they would be hidden from view, or at the very least, can be located along the side of the building whereby the cable assemblies 11 and 12 would be conveyed inwards towards the building by additional pulley assemblies. The winches 22 and 23 can also be set inside of the walls of the building in which case they would be encased in a fire retardant material such as asbestos. Moreover, the various manners by which the cable drivers 22 and 23 are controled can vary considerably. For example, the controls could include a series of buttons which would be electrically timed so as to actuate the cable drivers 22 and 23 such that they would stop at a respective elevation when pushed. Such could be accomplished with electrical cam means built into the control system or made integral with the cable assemblies 11 and 12 which would be provided with suitable means attached to the cable for actuating its respective cable drive assembly.

While the drawings illustrate the present escape system as comprising only a single pair of cables positioned on only one side of the building 13, it will be apparent to one skilled in the art that where there are building exits located in each side of a given building, then additional escape system can be provided on that face or side of the building. For example, should there be windows 31 located on all 4 sides of the building 13 shown in FIG. 1 of the drawings, then similar cable members to that as 11 and 12 as shown can be located on the opposite corners of the building and the suspension cable 25 be extended totally around the building. Of course, these additional cable members can be made to be separately operated on each side of the building or preferably, be tied in together such that only 4 vertical cable members are required. In the latter instance, the additional winch means required would of necessity have to be sychronized. It can also be appreciated by one skilled in the art that by using a combination of pulley means, only one winch need be employed which would be mechanically tied into all of the cables by passing the bottom portion of the vertical cables through various pulleys and conduits to the centrally located winch member. It can be further appreciated that the suspension cable 25 can in effect comprise a rigid steel member and in the case of the installation of the present system upon a round building, the suspension cable 25 could comprise a 360° radial steel ring.

In light of the above details, it can be appreciated by one skilled in the art that many modifications can be made in the instance invention is that as setforth and particularly pointed out in the appended claims.

What I claim as my invention is:

1. A vertical horizontal rescue system comprising:

(a) at least one pair of vertically oriented spaced apart cable means;

(b) adjustable pulley means adapted to receive said cable means and for mounting upon an elevated structure so as to allow said cable means to be vertically suspended therefrom and rotated therethrough;

(c) winch means operably attached to the bottom portion of said cable means and adapted for attachment to the bottom of an elevated structure in line with said adjustable pulley means whereby said cable means can be vertically actuated to go upwards and downwards along an elevated structure on which the present system is installed; and (d) horizontally positioned cable means operably attached to and suspended between said vertical cable means, said horizontally positioned suspended cable means being provided with a series of spaced apart enlarged portions so as to prevent a harness snap attached thereto from sliding across said cable means a predetermined length of travel.

2. The vertical horizontal rescue system of claim 1 further characterized in that:

said horizontally positioned suspension cable means further comprises support cable members operably attached to essentially its mid portion at one end of said support cable means and other end operably attached to the respective vertical cable means so as to provide additional support for said horizontal suspension cable means.

3. The vertical horizontal rescue system of claim 6 further characterized in that:

said control system is further define as comprising an auxiliary electrical circuit for attachement to the exterior of an elevated structure whereby the present system can be operated exteriorally of any control system located within the elevated structure.

* * * * *